US009364967B2

(12) United States Patent
Fastert et al.

(10) Patent No.: US 9,364,967 B2
(45) Date of Patent: Jun. 14, 2016

(54) DEVICE FOR CUTTING TO SIZE AND HANDLING A SUBSTANTIALLY EXTENSIVE BLANK FROM A CFK SEMI-FINISHED PRODUCT AND METHOD

(75) Inventors: Claus Fastert, Drochtersen (DE); Hans-Martin Krafft, Emmen (CH); Matthias Klein-Lassek, Düsseldorf (DE)

(73) Assignee: Airbus Operations GmbH, Hamburg (DE)

( * ) Notice: Subject to any disclaimer, the term of this patent is extended or adjusted under 35 U.S.C. 154(b) by 948 days.

(21) Appl. No.: 12/817,863

(22) Filed: Jun. 17, 2010

(65) Prior Publication Data

US 2010/0313722 A1 Dec. 16, 2010

Related U.S. Application Data

(63) Continuation of application No. PCT/EP2008/067064, filed on Dec. 9, 2008.

(60) Provisional application No. 61/008,403, filed on Dec. 20, 2007.

(30) Foreign Application Priority Data

Dec. 20, 2007 (DE) ..... 10 2007 061 427

(51) Int. Cl.
*B26D 5/20* (2006.01)
*B26D 7/01* (2006.01)
(Continued)

(52) U.S. Cl.
CPC *B26D 7/018* (2013.01); *B26D 7/27* (2013.01); *B26D 7/22* (2013.01); *Y10T 83/0453* (2015.04); *Y10T 83/0467* (2015.04); *Y10T 83/207* (2015.04); *Y10T 83/851* (2015.04)

(58) Field of Classification Search
CPC ..... B26D 2007/01; B26D 2007/32; B26D 2007/18; B26D 2007/1881; B26D 2007/1809; B26D 2007/189; B26D 7/1863; H01M 4/96; H01L 22/26; B23Q 17/09; B23Q 17/0909; B23Q 17/2241
USPC ..... 83/16, 63, 76.8, 80, 98, 100, 367–368, 83/177, 358–359, 61, 66, 73, 364–365, 83/929.2, 24, 25, 152, 370–371, 522.26, 83/956, 27; 156/538; 324/207.15, 199, 324/133, 76.11; 29/559, 743, 413; 219/69.16, 68, 69.13, 383; 192/127; 72/330, 331
See application file for complete search history.

(56) References Cited

U.S. PATENT DOCUMENTS 181,078 A * 8/1876 Larned ..... 340/550
1,907,756 A * 5/1933 Drake ..... 324/241
(Continued)

FOREIGN PATENT DOCUMENTS

DE 2301736 A1 8/1973
DE 69905752 T2 10/2003
(Continued)

OTHER PUBLICATIONS

German Office Action from DE 10 2007 061 427.8 dated Sep. 2, 2008.
(Continued)

*Primary Examiner* — Stephen Choi
*Assistant Examiner* — Fernando Ayala
(74) *Attorney, Agent, or Firm* — Jenkins, Wilson, Taylor & Hunt, P.A.

(57) ABSTRACT

A device for cutting to size and handling a substantially planar blank from a planar CFRP semi-finished product positioned on a cutting table by a cutting means, it being possible for the separated blank to be drawn up by suction and at least raised by a vacuum effector, characterized in that at least one blank electrode can be brought into contact with the blank and at least one peripheral electrode can be brought into contact with a peripheral portion separated from the CFRP semi-finished product and the at least two electrodes are connected to a voltage source and to a measuring means, the measuring means being able to detect a complete separation of the blank from the CFRP semi-finished product.

2 Claims, 2 Drawing Sheets

(51) Int. Cl.

| | |
|---|---|
| ***B26D 7/27*** | (2006.01) |
| *B26D 7/22* | (2006.01) |

(56) References Cited

U.S. PATENT DOCUMENTS

| | | | | | |
|---|---|---|---|---|---|
| 2,828,465 | A * | 3/1958 | Morton | 324/423 | |
| 3,068,336 | A * | 12/1962 | Tamm | 219/602 | |
| 3,339,434 | A * | 9/1967 | Sparling | 408/6 | |
| 3,618,065 | A * | 11/1971 | Trip et al. | 340/568.3 | |
| 3,636,441 | A * | 1/1972 | Fujimura et al. | 324/718 | |
| 3,916,138 | A * | 10/1975 | Pfau | 219/69.13 | |
| 4,030,387 | A * | 6/1977 | Finnimore | 83/49 | |
| 4,293,778 | A * | 10/1981 | Williams | 307/147 | |
| 4,306,136 | A * | 12/1981 | Delpretti | 219/69.18 | |
| 4,547,646 | A * | 10/1985 | Briffod | 219/69.12 | |
| 4,916,278 | A * | 4/1990 | Rudd et al. | 219/602 | |
| 5,040,915 | A * | 8/1991 | Stuart et al. | 403/322.3 | |
| 5,284,043 | A * | 2/1994 | Hayashi | 72/330 | |
| 5,463,921 | A * | 11/1995 | Bellio et al. | 83/151 | |
| 6,114,676 | A * | 9/2000 | Jerby et al. | 219/690 | |
| 6,134,999 | A * | 10/2000 | Herman | B26D 1/02 83/35 | |
| 6,204,306 | B1 * | 3/2001 | Chabrecek | C07C 271/20 351/159.01 | |
| 6,343,639 | B1 | 2/2002 | Kaye et al. | | |
| 6,481,939 | B1 * | 11/2002 | Gillespie et al. | 409/131 | |
| 7,059,243 | B1 * | 6/2006 | Gatta | 101/3.1 | |
| 7,256,692 | B2 * | 8/2007 | Vatsaas et al. | 340/550 | |
| 7,728,607 | B2 * | 6/2010 | Forbes | 324/755.02 | |
| 7,833,367 | B2 * | 11/2010 | Yamamoto et al. | 156/64 | |
| 7,919,971 | B2 * | 4/2011 | Horn | 324/700 | |
| 2001/0003936 | A1 * | 6/2001 | Song | 83/24 | |
| 2003/0172785 | A1 * | 9/2003 | Formon et al. | 83/37 | |
| 2007/0257666 | A1 * | 11/2007 | Laure et al. | 324/207.15 | |
| 2009/0133554 | A1 * | 5/2009 | Pan | 83/72 | |

FOREIGN PATENT DOCUMENTS

| | | | |
|---|---|---|---|
| DE | 10252671 | C1 | 12/2003 |
| GB | 1382541 | A | 2/1975 |
| RU | 2081225 | | 6/1997 |
| RU | 2114780 | | 7/1998 |
| WO | WO 00/32381 | | 6/2000 |
| WO | WO 2009/080490 | | 7/2009 |

OTHER PUBLICATIONS

International Search Report and Written Opinion from PCT/EP2008/067064 dated Mar. 19, 2009.

Russian Decision to Grant for Application No. 2010122805/02 dated Oct. 29, 2012.

* cited by examiner

DEVICE FOR CUTTING TO SIZE AND HANDLING A SUBSTANTIALLY EXTENSIVE BLANK FROM A CFK SEMI-FINISHED PRODUCT AND METHOD

CROSS-REFERENCE TO RELATED APPLICATIONS

This application is a continuation of PCT/EP2008/067064 and claims the benefit of U.S. Provisional Application No. 61/008,403 filed Dec. 20, 2007, and German Patent Application No. 10 2007 061 427.8 filed Dec. 20, 2007, the entire disclosures of which are herein incorporated by reference.

FIELD OF THE INVENTION

The invention relates to a device for cutting to size and handling a substantially planar blank from a planar CFRP semi-finished product which is positioned on a cutting table, using a cutting means, it being possible for the separated blank to be drawn up by suction and at least lifted by a vacuum effector.

Furthermore, the invention relates to a method for the production of blanks from a planar blank using the device according to the invention, it being possible for an incomplete severing to be automatically detected and, if necessary, to be eliminated automatically.

BACKGROUND OF THE INVENTION

Components consisting of fibre-reinforced plastics are used to an increasing extent in modern aircraft construction. To produce components of this type, a large number of planar semi-finished fibrous products are layered one on top of another to obtain a fibre preform until a predetermined component shape is achieved. The individual reinforcement fibre layers can each have different peripheral geometries in order to produce preforms with an almost random surface geometry. For this purpose, blanks with a suitable peripheral geometry have to be separated with high precision from the planar semi-finished fibrous product on suitable automatic cutting mechanisms. Semi-finished fibrous products which are preferably used are woven fabrics, scrims or knitted fabrics with carbon fibres (so-called "CFRP semi-finished products").

The (fibre) preform formed in this manner with carbon fibres, substantially following a three-dimensional shape of the CFRP component to be produced is introduced in the course of a production process into a mould, for example, which corresponds to the geometric shape of the CFRP component to be produced and is impregnated with a curable plastics material, for example an epoxy resin. Finally or simultaneously, curing is carried out while applying pressure and/or temperature, to produce a dimensionally accurate component (so-called "RTM process", "Resin Transfer Moulding").

In order to achieve as fully an automatic production of the fibre preforms as possible in the RTM process, a vacuum effector, for example, is used to draw up the separated-out blanks by suction, to lift them up and deposit them, for example in an RTM mould for the layered construction of a preform, such that in a final process step, impregnation with the curable plastics material can be carried out. The vacuum effector of the device is generally positioned spatially in a fully automatic manner by a handling device, in particular by an articulated robot arm which has a plurality of degrees of freedom.

Problems arise in the automatic production sequence it during the automatic cutting procedure in the cutting device, not all carbon fibres are completely severed. In this case, when an attempt is made to lift up the blank from the cutting table by the vacuum effector, disturbances in the production flow generally ensue because the position of the blank changes under the vacuum effector. Thus the exact spatial position of the blank is no longer known and the correct positioning thereof with respect to a mould is no longer guaranteed. In this case, provided that the integrity of the blank has not been damaged by being torn off from the CFRP semi-finished product, it is only possible to correct the position by a complex manual re-positioning.

SUMMARY OF THE INVENTION

Therefore, one object of the invention is to provide a device for the fully automated cutting of blanks from a planar CFRP semi-finished product as the starting material, in which device an incomplete severing of carbon fibres is automatically detected and, if necessary, incompletely severed carbon fibres are automatically severed after the actual cutting procedure. Furthermore, the device should be capable of automatically transferring or delivering a correctly separated blank to a production stage connected downstream.

Due to the fact that at least one blank electrode can be brought into contact with the blank and at least one peripheral electrode can be brought into contact with a peripheral portion separated from the CFRP semi-finished product and the at least two electrodes are connected to a voltage source and to a measuring means, said measuring means being able to detect the complete separation of the blank from the CFRP semi-finished product, it is possible for a blank which has not been out or separated completely from the CFRP semi-finished product to be detected in a fully automatic manner. In this case, the signalling means allows, for example a simple visual signalling and/or the transfer of a corresponding error signal to a control means which can initiate further steps for the complete separation of the blank from the CFRP semi-finished product.

The term "CFRP semi-finished product" defines a substantially planar, originally still "dry" reinforcing fibre arrangement. The reinforcing fibre arrangement is preferably formed with a carbon fibre scrim, woven fabric, knitted fabric, interlaced fabric or the like which has not yet finally been saturated or impregnated with a curable plastics material to produce the finished CFRP component. In principle, the invention can also be applied to other semi-finished fibre products, assuming an adequate electrical conductivity of the reinforcing fibres for the severing indication. Alternatively, provided there is a suitable cutting method, the invention can also be applied to planar "prepreg" materials, in other words, to reinforcing fibre arrangements, in particular carbon fibre reinforcing arrangements, which have already been pre-impregnated with a curable plastics material, but which have not yet cured or completely cured.

A peripheral electrode can be electrically contacted with a peripheral portion separated or to be separated from the CFRP semi-finished product, while a blank electrode can be electrically connected to the separated blank. The two electrodes which are preferably configured to be planar and not punctiform can be formed, for example by a drilled board or by a fabric or meshwork consisting of a conductive material. If the blank electrode is arranged in the suction region of the vacuum effector, the drilled board or the metallic fabric does not hinder the effect of the vacuum on the blank drawn up by suction. Due to the vacuum effect, the blank is generally pressed against the blank electrode with a sufficiently great force such that an adequate electrical contact is always ensured. Therefore, a resilient holding means for attaching the blank electrode and ensuring a sufficiently high contact pressure for a sufficient electrical contact is generally not required, in contrast to the peripheral electrode.

The electrodes are connected to a voltage source and to a measuring device, particularly in the form of an ammeter or an ohmmeter. The voltage source is preferably a direct current source, since possible variations in resistance or fluctuations in the flow of current can be detected more simply and more precisely by direct current. Alternatively however, the measurement can also be made using an alternating voltage source.

When, for example the uncut CFRP semi-finished product is positioned on the cutting table and the vacuum effector has been fully lowered onto the CFRP semi-finished product, an (initial or static) direct current I of significantly more than 0 mA initially flows, starting from the positive pole of the constant voltage source, via the ammeter and the peripheral electrode through the electrically conductive CFRP semi-finished product via the blank electrode back to the negative pole of the constant voltage source. An absolute height of this direct current I depends not only on the conductivity of the CFRP semi-finished product, but also on the geometric shape of the blank, the superficial extent of the electrodes, the contact pressure thereof and on the geometric shape of the CFRP semi-finished product and, in the case of typical blanks, is up to 10 A (amps).

The CFRP semi-finished product is, for example a carbon fibre woven fabric with a binder, for example Hexcel® G0926 and Hexcel® G1157. In principle, the device can be used for the blank of any reinforcing fibre woven fabric, scrim or the like, as long as such fabrics have an adequate electrical conductivity, in order to reliably detect the incomplete severing of individual reinforcing fibres.

After being deposited onto the cutting table, and with the vacuum effector usually having been fully raised, the blank is cut out of the planar CFRP semi-finished product in a fully automatic manner with a required peripheral contour by a blade which oscillates vertically with a frequency of up to 18,000 strokes/minute.

To determine the complete severing of all the carbon fibres after the conclusion of the cutting procedure, the vacuum effector is then lowered onto the separated blank, thereby drawing the blank up by suction and holding it. During this procedure, regardless of whether all the carbon fibres in the CFRP semi-finished product have been correctly severed or not, a (measuring) current I initially continues to flow with an intensity which is substantially unchanged compared to the (initial or static) current I which flows in the uncut state, since the adjoining cut surfaces between the blank and the CFRP semi-finished product still allow the passage of current.

The blank is finally raised to a measuring height of a few millimetres by the upwards movement of the vacuum effector. However, if the current I does not fall to a value of approximately 0 mA in this slightly raised state of the blank, this is a reliable indication that the preceding cutting procedure was incomplete, in other words that remaining between the blank and the peripheral portion, surrounding the blank, of the CFRP semi-finished product are bridging filaments, carbon fibre bridges or separate carbon fibres through which the direct current I can continue to flow, although with a greatly reduced intensity. In this case, it is necessary to immediately stop any further raising of the blank and the further transport thereof to downstream production stages or production units, so that the entire production flow is not impaired.

The measuring height preferably corresponds to at least the material thickness of the CFRP semi-finished product plus a safety margin of a few millimetres.

The output signal or the current I generated by the ammeter or the ohmmeter as a measuring device can be used for simple notification or information to a user or machine operator about the fault and/or also as an electrical error signal to be transmitted to a control means of the entire (cutting) device, in order for example to initiate an automated severing of the incompletely severed fibres.

An embodiment of the device provides that the at least two electrodes, the voltage source, the measuring means and the uncut CFRP semi-finished product form a closed electrical circuit in a lowered state of the vacuum effector. Consequently, the complete severing of the CFRP semi-finished product can be detected in a simple and particularly reliable manner by the presence of an electric current flow I in a closed circuit.

A further advantageous embodiment of the device provides that the measuring means is in particular an ammeter, a current I with an amperage of significantly more than 0 mA indicating an incomplete severing of the blank when the blank has been raised by a measuring height. This prevents measuring errors, because the amperage of the current I for a blank which has not been raised to a measuring height of, for example 5 mm is always greater than 0 mA due to currents in the contact region between the adjoining cut surfaces of the CFRP semi-finished product and the blank.

According to a further embodiment of the device, the current I can be increased for a short time or in a pulsed manner to a maximum value of $I_{Max}$ in order to melt through carbon fibre bridges or carbon fibre filaments which may possibly still be present between the blank and the CFRP semi-finished product by an increased flow of current and, in this manner, to complete the full separation.

Consequently, the cutting device according to the invention can be used in fully automated production lines for the production of CFRP components. The maximum value of the current $I_{Max}$ required for melting remaining carbon fibre bridges is up to 100 A (amps). After the carbon fibre bridges have been completely melted, the blank can be delivered to further production stages, for example to a mould for a subsequent RTM process by the vacuum effector using a handling device, in particular an articulated robot arm which has at least six degrees of freedom.

Furthermore, a method having the following steps is provided:

a) depositing a substantially planar CFRP semi-finished product onto a cutting table,
b) cutting a blank which has a predetermined peripheral contour out of the CFRP semi-finished product by a cutting means,
c) lowering a vacuum effector for drawing up the blank by suction and depositing it, at least one blank electrode contacting the blank and at least one peripheral electrode contacting a separated peripheral portion of the CFRP semi-finished product,
d) raising the blank by the vacuum effector at least up to a measuring height, and
e) measuring a current I flowing between the at least two electrodes by a measuring means, in particular an ammeter, a current I of more than 0 mA indicating an incomplete separation of the blank from the CFRP semi-finished product.

This procedural method allows a very reliable detection of carbon fibre bridges which remain still incompletely separated at the end of the cutting procedure. Raising the blank to a measuring height prevents error currents which would lead to incorrect measurement results, since immediately after the cutting procedure, the cut surfaces of the CFRP semi-finished product and of the blank are still adjacent to one another in the separating zone, through which a current I always flows regardless of a complete separation, which current I can lead to misinterpretations.

Further advantageous embodiments of the device and method are provided in the further claims.

BRIEF DESCRIPTION OF THE DRAWINGS

In the drawings.

In the drawings, the same constructive elements have the same reference numerals in each case.

DETAILED DESCRIPTION OF THE DRAWINGS

Figure 1:
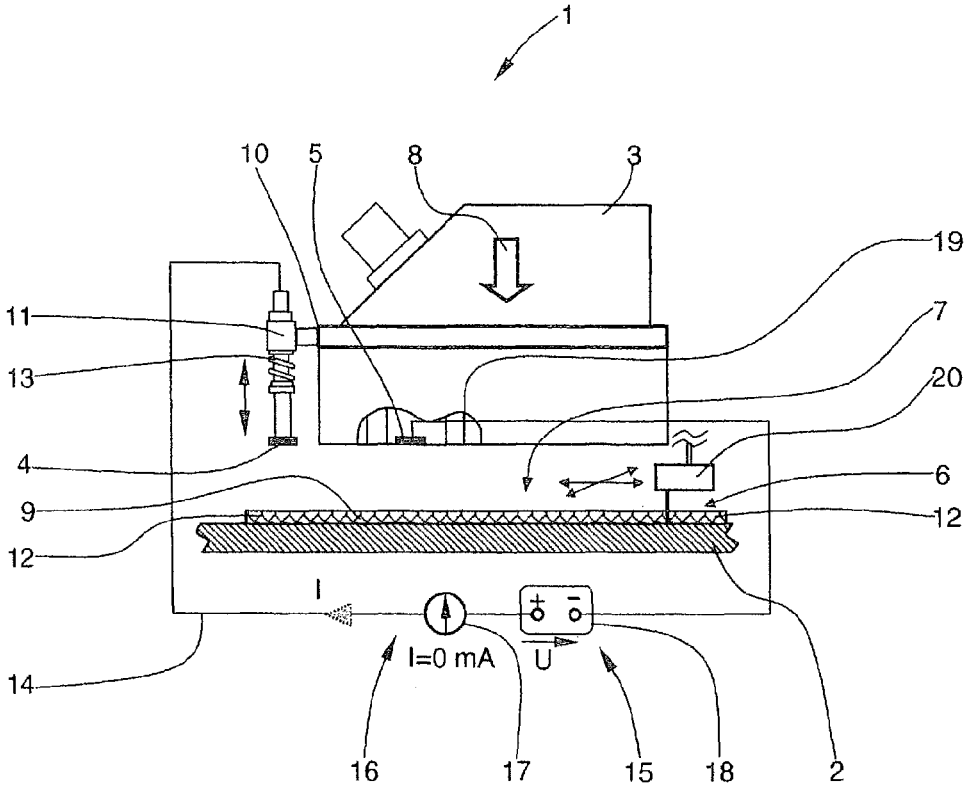
FIG. 1 shows a device in a starting position with a CFRP semi-finished product having been deposited on the cutting table and the vacuum effector in a fully raised position.
Figure 2:
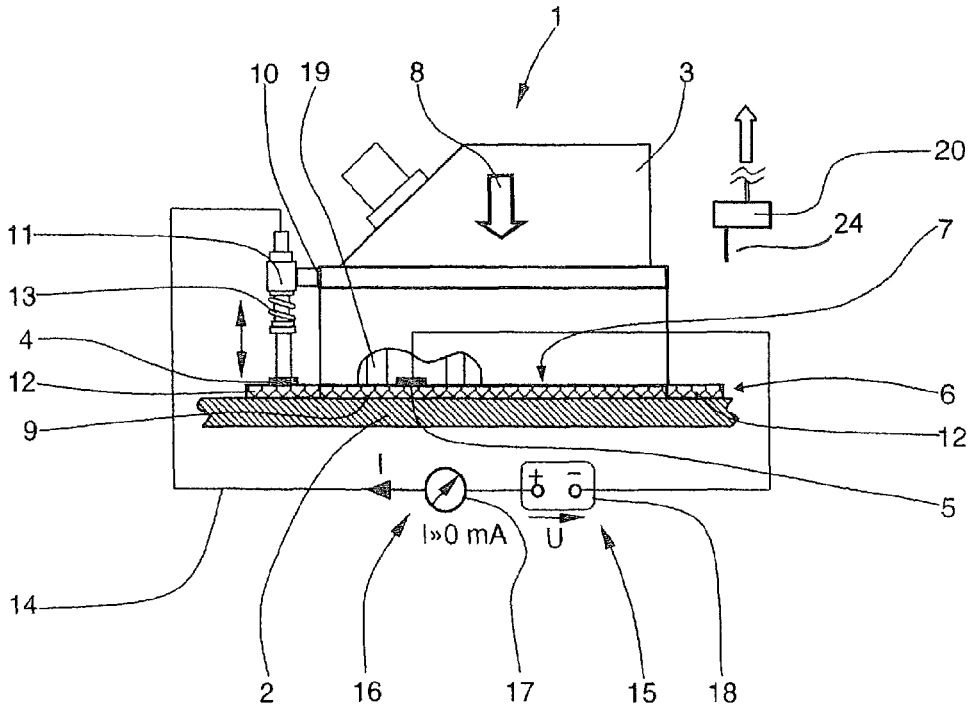
FIG. 2 shows the device with the vacuum effector in a fully lowered position.

FIGS. 1 and 2 are schematised views of the device with a (CFRP) semi-finished product positioned on the cutting table, the vacuum effector being raised in FIG. 1 and being fully lowered in FIG. 2. The actual cutting procedure of the CFRP semi-finished product positioned on the cutting table is preferably carried out in the raised position of the vacuum effector shown in FIG. 1 by a suitable cutting means and has been concluded in FIG. 1. The CFRP semi-finished product or the blank can have a planar surface geometry or a surface geometry which is (slightly) curved in at least one spatial direction (curved spherically).

The device 1 comprises, inter alia, a cutting table 2 and a vacuum effector 3 with a peripheral electrode 4 and a blank electrode 5. A planar CFRP semi-finished product 6 which is to be cut out by the device 1 has been deposited on the cutting table 2. The blank electrode 5 is arranged in a suction region 7 of the CFRP of the vacuum effector 3 and when the vacuum effector 3 is lowered in the direction of the arrow 8, it produces an electrical contact with the CFRP semi-finished product 6 or with the blank 9 to be separated therefrom. The peripheral electrode 4 is attached in the region of an outer edge 10 of the vacuum effector 3 by a holding means 11. When the vacuum effector 3 is lowered, the peripheral electrode 4 produces an electrical contact with a peripheral portion 12 of the CFRP semi-finished product 6, which electrical contact is present while the blank 9 is being cut out. The holding means 11 has a (pressure) spring 13, so that when the vacuum effector 3 is lowered parallel to the double-headed arrow shown in bold, the peripheral electrode 4 can be positioned resiliently on the CFRP semi-finished product 6 and the electrical contact is maintained even when the vacuum effector 3 is slightly raised (at least to a measuring height) against the orientation of arrow 8. The vertical spring excursion of the holding means 11 of the peripheral electrode 4 can amount to a few millimetres. Both electrodes 4, 5 are formed, for example with a metallic perforated plate or with a metal braiding in order to provide as large a contact surface as possible on the CFRP semi-finished product 6. The perforated plate or the metal braiding of the electrodes 4, 5 is preferably formed with an electrically good conductive, corrosion-resistant metal alloy, for example with a copper, silver, aluminium or titanium alloy, or any combination thereof.

Both the peripheral electrode 4 and the blank electrode 5 are interconnected to a voltage source 15 and a measuring means 16 to form an electrical (direct) current circuit which is closed at least in the lowered state of the vacuum effector 3 via electrical lines, of which only one electrical line 14 is provided with a reference numeral in representation of the other lines.

In the illustrated embodiment of FIGS. 1 to 4, the measuring means 16 is a (dc) ammeter 17 and the voltage source 15 is preferably configured as a constant voltage source 18 with a positive pole and a negative pole. Prevailing between the positive pole and the negative pole of the constant voltage source 18 is an electrical direct voltage U, a current I flowing sequentially in the lines 14 when there is a sufficiently low electrical resistance between the peripheral electrode 4 and the bank electrode 5, which current I is measured and indicated by the ammeter 17. Furthermore, the value of current measured by the ammeter 17 can be further relayed to a control means (not shown) for evaluation and automatic initiation of process steps dependent thereon. In the view of FIG. 1, the current I has approximately a value of 0 mA, because there is a sufficiently high (air) insulation resistance between the two electrodes 4, 5.

The vacuum effector 3 is spatially attached to a handling device (not shown), in particular an articulated robot arm (standard industrial robot) which has at least six degrees of freedom, for the arbitrary spatial positioning of the sucked-up blank 9. The blank 9 is freely spatially positioned by the handling device in the position of the vacuum effector 3 which is fully raised from the cutting table 2 and is shown in FIG. 1. The vacuum effector 3 has a large number of suction means, for example in the form of small suction caps or suction pipes preferably arranged in matrix form, for suctioning and holding the dry blank 9 in the suction region 7, of which, to improve clarity, only one suction means 19 is provided with a reference numeral representing the other suction means. In this arrangement, only those suction means 19 are preferably subjected to a vacuum which are required for covering the blank 9. The vacuum effector 3 is cable of suctioning blanks 9 of virtually any geometric shape, controlled by the control means (not shown), and lifting them up from the cutting table 2 against the orientation of arrow 8 and transferring them to production units connected downstream. For example, the vacuum effector 3 can introduce blanks 9 in an automated manner into a mould for an RTM production process downstream, and can position and stack the blanks therein to allow a substantially fully automatic production of dimensionally accurate CFRP components.

In the view of FIG. 2, the vacuum effector 3 is shown in a position which is lowered onto the already cut CFRP semi-finished product 6. Consequently, the peripheral electrode 4 and the blank electrode 5 come into electrical contact with the CFRP semi-finished product 6. Due to the direct voltage U at the electrodes 4, 5, of the constant voltage source 18, an electric current I of significantly more than 0 mA flows through the electrical lines 14 on account of the electrical conductivity, still present, of the CFRP semi-finished product 6. Compared to the current I flowing in the case of the uncut blank 9 when the vacuum effector 3 has been lowered, this current I is only slightly reduced, since the adjoining cut surfaces still have in the region of the separating zone a sufficiently low transition resistance or a sufficiently high conductivity. The intensity of the current I is measured by the ammeter 17 and indicated as a current measured value and/or is transmitted to the control means of the entire device 1.

In the completely raised state (cf. FIG. 1), the blank 9 is preferably separated from or cut out of the CFRP semi-finished product 6 by a cutting means 20 which is only indicated schematically, the peripheral region 12 of the CFRP semi-finished product 6 remaining. The cutting means 20 is preferably at least one blade or cutting edge 24 which oscillates vertically with a frequency of up to 18,000 strokes per minute and is guided automatically along any desired contour of the blank 9. The cutting means 20 can be freely positioned at least in the plane of the CFRP semi-finished product, as indicated in FIG. 1 by the crossed double-headed arrows, and optionally also in the z direction. In the view of FIG. 2, the cutting means 20 has been lifted off or removed from the cutting table 2, which is indicated by the vertically upwardly pointing arrow in the region of the cutting means 20. The effect of the spring 13 on the holding means 11 provides a secure electrical contact between the peripheral electrode 4 and the blank 9. Regardless of the complete severing of all carbon fibres, at the end of the cutting procedure a current I still flows, although it may possibly be reduced, since the cut surfaces of the blank 9 which have not been provided with a reference numeral rest flush against corresponding cut surfaces of the CFRP semi-finished product 6 in the cutting region.

Figure 3:
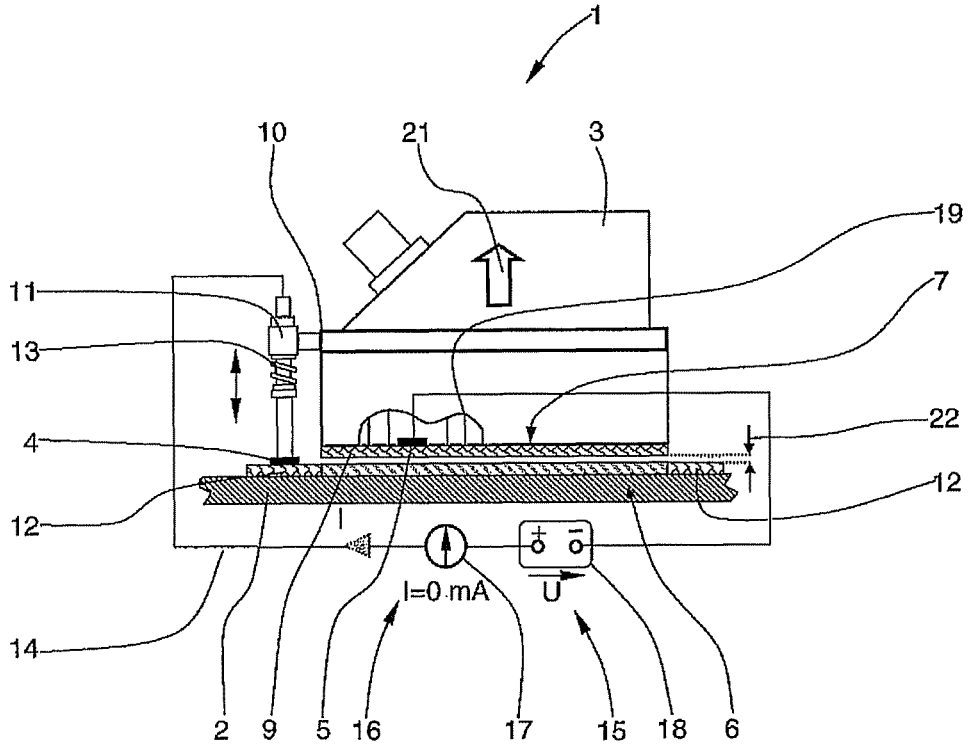
FIG. 3 shows the device with a blank which has been raised to a measuring height and has been perfectly cut out.
Figure 4:
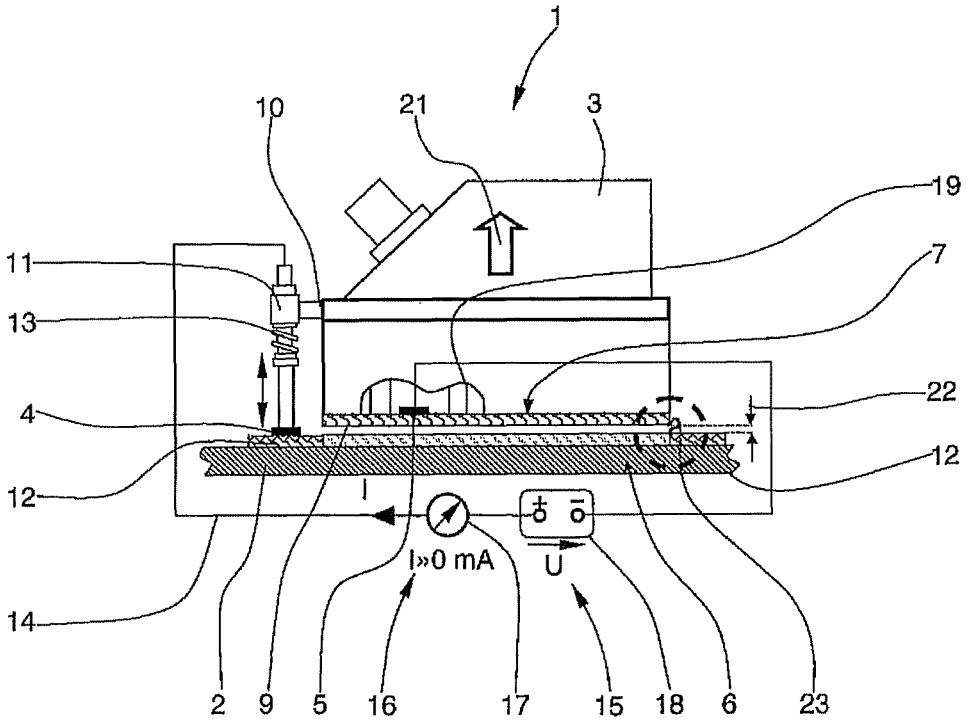
FIG. 4 shows the device with a blank which has been raised to the measuring height but has not been fully cut out (carbon fibre bridges).

FIG. 3 illustrates a successfully completed cutting procedure, while in FIG. 4 by way of example an individual carbon fibre bridge remains at the end of the cutting procedure between the blank 9 and the CFRP semi-finished product 6. FIG. 3, 4 show the vacuum effector 3 not in the fully raised position (cf. FIG. 1), but in the so-called measuring position.

At the end of the actual cutting procedure for separating the blank 9 from the surrounding CFRP semi-finished product 6, the vacuum effector 3 together with the sucked-up blank 9, as can be seen in FIG. 3, is slightly raised in the direction of arrow 21 to a measuring height 22 in relation to an unreferenced upper side of the CFRP semi-finished product 6. When the preceding cutting procedure has been successfully completed, current I no longer flows through the electrical lines 14, i.e. the amperage of the current I is in the order of magnitude of 0 mA, so that the ammeter 17 does not move (current interruption) and no error signal is released to the control means. The raising of the vacuum effector 3 from the cutting table 2 to the measuring height 22 is significant for the reliability of the results, because even in the case of a complete severing when the blank 9 has not been raised, current I still flows through the separating zone (cutting region or cut) between the CFRP semi-finished product 6 and the cut out blank 9.

The measuring height 22 can be up to 5 mm, but a measuring height 22 is preferably only adjusted which is slightly greater than the material thickness of the CFRP semi-finished product 6.

In FIG. 4, the vacuum effector 3 is also in the so-called measuring position, but at the end of the cutting procedure, a carbon fibre bridge 23 remains between the CFRP semi-finished product 6 and the separated blank 9, as indicated by the circle shown in bold dashed lines.

As a result of this incomplete separation of the blank 9 from the CFRP semi-finished product 6, a current I flows through the lines 14, which current I has an amperage of significantly more than 0 mA. Consequently, the ammeter 17 moves and a corresponding control signal or error signal is transmitted to the control means. If the vacuum effector 3 should be raised further in the direction of arrow 21, irrespective of this error, the carbon fibre bridge 23 would indeed tear upon reaching a sufficiently great tensile force. However, the blank 9 drawn up by suction by the vacuum effector 3 can slip on the suction region 7 due to this force effect, so that a defined position of the blank 9 is no longer provided and, for example, the subsequent automated insertion of the blank 9 into a mould for an RTM process is no longer easily possible.

In order not to disrupt a fully automatic production process of this type, if the error signal arrives at the control means in the form of an incomplete severing, the current I is increased for a short time (pulsed) up to a maximum value $I_{Max}$ in an order of magnitude of up to 100 A to rapidly melt through, burn or separate the carbon fibre bridge 23. Subsequently, the blank 9 can be fully raised by the vacuum effector 3 from the cutting table 2 in the direction of arrow 21 in the usual manner and moved on to subsequent production stages.

The method according to the invention, preferably using the cutting device 1, is devised as follows.

In a first step, a planar CFRP semi-finished product 6 is positioned onto the cutting table 2 of the device 1. When the vacuum effector 3 is lowered onto an uncut CFRP semi-finished product 6, a (static) current I of up to a few A (amps) is usually present.

In a second step, with the vacuum effector 3 preferably being fully raised, the blank 9 is cut in a preferably fully automatic manner out of the CFRP semi-finished product 6, almost any contouring of the blank 9 being possible.

In a third step, the vacuum effector 3 is lowered onto the CFRP semi-finished product 6 and the blank 9 is then drawn up by suction by means of a vacuum. Consequently, the constant voltage source 18 is connected via the electrical lines 14 to the peripheral electrode 4 and the blank electrode 5 to form a closed, electric (direct) current circuit. Also in the case of a complete, i.e. correct separation of the blank 9 from the starting material, a current I flows in this state which is still greater than 0 mA, but is usually considerably less than the current I which flows before the cutting procedure. In the cutting region, the blank 9 and the CFRP semi-finished product 6 still contact one another along the opposing cut surfaces, so that there is still a sufficiently low transition resistance for the current flow I.

In a fourth step, the vacuum effector 3 is moved together with the sucked-up blank 9 in a vertical direction to a measuring height 22, i.e. is raised from the cutting table 2. The spring 13 on the holding means 11 ensures a reliable contact between the peripheral electrode 4 and the peripheral portion 12 of the CFRP semi-finished product 6, even when the vacuum effector 3 has been raised. The measuring height 22 amounts up to 5 mm, but it preferably approximately corresponds to the material thickness of the (single-layer) CFRP semi-finished product 6.

In a fifth step, the relevant measurement of a current I is finally made by the ammeter 17, which current I flows between the peripheral electrode 4, the blank electrode 5 and the constant voltage source 18 when there has been an incomplete cut.

If the cutting procedure has taken place correctly, i.e. no carbon fibre bridges 23 or separate carbon fibre filaments remain between the blank 9 and the CFRP semi-finished product 6, the current I, or to be precise, the measured current has a value of approximately 0 mA. This current I of approximately 0 mA is forwarded by the ammeter 17 to the control means as a clear "error-free" signal and, as a result, the control means initiates the forwarding or the further transportation of the blank 9 to production stages connected downstream.

However, if carbon fibre bridges 23 remain, the amperage of the current I when the blank 9 is raised is still significantly greater than 0 mA. In this case, the current value measured by the ammeter 17 forwarded to the control means is an "error signal". The current I can then be automatically increased to a maximum value $I_{Max}$ of up to 100 A (amps) which produces the immediate melting or glowing away (melting through) of the carbon fibre bridges 23 and thus the final separation of the blank 9 from the CFRP semi-finished product 6.

The blank 9 can then be forwarded in the usual manner and without disturbances in the automatic production flow to a subsequent production station. In this respect, for example a plurality of blanks 9 are positioned one on top of another in a mould for a subsequent RTM process and finally steeped or impregnated with a curable plastics material, in particular an epoxy resin, while applying pressure and temperature, to produce the finished CFRP component.

What is claimed is:

1. A method for cutting and lifting a blank out of Carbon Fibre Reinforced Polymer (CFRP) semi-finished product by a device, comprising:

depositing a substantially planar CFRP semi-finished product onto a cutting table, cutting a blank which has a predetermined peripheral contour out of the CFRP semi-finished product, lowering a vacuum effector for drawing up the blank by suction and depositing it, at least one blank electrode contacting the blank and at least one peripheral electrode contacting a separated or separate peripheral portion of the CFRP semi-finished product, raising the blank by the vacuum effector above a measuring height, and measuring a current flowing between the at least two electrodes by a measuring means, a measurement of the current of more than 0 mA indicating an incomplete separation of the blank from the CFRP semi-finished product; wherein the current is increased for a short time to a maximum value upon the blank reaching the measuring height and when the current has a measured value of more than 0 mA, to produce a complete separation between the blank and the CFRP semi-finished product by the melting of at least one carbon fibre bridge connecting the blank with the CFRP semi-finished product;

positioning the completely separated blank; and delivering the completely separated blank to a mould in an Resin Transfer Moulding (RTM) process.

2. The method according to claim 1, wherein the measuring means is an ammeter.

* * * * *